United States Patent [19]

Yoshigae

[11] Patent Number: 4,484,044

[45] Date of Patent: Nov. 20, 1984

[54] VACUUM LOAD SWITCH WITH A DISCONNECTING SWITCH

[75] Inventor: Kiyohisa Yoshigae, Kounosu, Japan

[73] Assignee: Fuji Electric Company, Ltd., Kanagawa, Japan

[21] Appl. No.: 398,655

[22] Filed: Jul. 15, 1982

[30] Foreign Application Priority Data

Jul. 16, 1981 [JP] Japan ..... 56-111152

[51] Int. Cl.[3] ..... H01H 33/66

[52] U.S. Cl. ..... 200/144 B; 200/145

[58] Field of Search ..... 200/144 B, 145, 146 R

[56] References Cited

U.S. PATENT DOCUMENTS

| | | | |
|---|---|---|---|
| 3,399,286 | 8/1968 | Kerr, Jr. | 200/144 B |
| 3,597,713 | 8/1971 | McClain et al. | 200/144 B |
| 3,646,294 | 2/1972 | McCloud | 200/144 B |
| 3,848,101 | 11/1974 | Eberhard et al. | 200/146 R |

FOREIGN PATENT DOCUMENTS

| | | | |
|---|---|---|---|
| 2000322 | 9/1969 | France | 200/146 R |
| 1107855 | 3/1968 | United Kingdom | 200/144 B |

*Primary Examiner*—Robert S. Macon

*Attorney, Agent, or Firm*—Brumbaugh, Graves, Donohue & Raymond

[57] ABSTRACT

A load switch includes a vacuum switch in series with an air disconnecting switch. The vacuum switch comprises a fixed electrode, a movable electrode attached to one end of an axially movable control rod and a retaining spring which exerts a resilient force on the control rod tending to separate the electrodes. The air disconnecting switch comprises a conically shaped male contact and an opposing female contact shaped to permit insertion of the male contact therein. The male contact has a relatively large diameter base portion attached to the other end of the control rod and forming a step with the control rod. The female contact has spring loaded locking projections for releasably engaging the step of the male contact and a stopper for exerting a force on the control rod sufficient to close the electrodes of the vacuum switch when the male contact is moved against the stopper after engagement with the female contact. The spring loading of the locking projections of the female contact, the shape of the male contact and the spring constant of the retaining spring are selected such that the force on the control rod during engagement of the male and female contacts is not sufficient to close the electrodes of the vacuum switch, while the force on the control rod during disengagement of those contacts acts to fully separate the electrodes of the vacuum switch prior to the release of the male contact.

8 Claims, 3 Drawing Figures

VACUUM LOAD SWITCH WITH A DISCONNECTING SWITCH

BACKGROUND OF THE INVENTION

This invention relates to a vacuum load switch with a disconnecting switch including a vacuum valve and an air disconnecting switch combined together.

In general, it is naturally required for load switches to perform the supplying or cutting-off of a load current as needed. In addition to the above, since they are housed in a switchboard or the like, the load switches are desired to permit the visual confirmation of safety, i.e. the open state of electrodes, to minimize a space to be occupied and to prevent the leakage of arcs which occur when the switch is opened or closed. It is also desired for such switch to resist the high frequent operation and have a longer life time. In some air disconnecting switches of linearly reciprocating type or blade rotating type, it is possible to perform the visual confirmation of safety and to easily obtain an insulating distance between electrodes in the open state. However, any of those disconnecting switches makes it almost impossible that arcs which occur when the switch is opened or closed are completely prevented from leaking to the outside, and the life time is prolonged while permitting the high frequent operation. On the other hand, there have been known vacuum switches as a switch of small size, which can prevent the leakage of arcs which occur when the switch is opened or closed and can resist the use of a long life time even under the high frequent operation. But the vacuum switches have such a drawback that a distance between electrodes is small in the open state. For example, the distance between electrodes is less than 10 mm in the class of 2.7 kV. Therefore, when visually judging whether the electrodes are closed or opened, there may occur erroneous judgment due to a small change in the distance between electrodes of the vacuum switch. From such condition, there has been hoped to develop a small size, long life load switch which can at least perform the visual confirmation of safety, by utilizing advantages of the air disconnecting switch and the vacuum switch while compensating disadvantages thereof.

SUMMARY OF THE INVENTION

In view of the foregoing condition in the past, it is an object of this invention to provide through the combination of air disconnecting switches and vacuum valves a vacuum load switch with a disconnecting switch, which can perform the visual confirmation of safety, has a small size and a longer life time, and occupies a reduced space.

According to this invention, the above object is achieved by a load switch comprising; a vacuum valve including an axially movable control rod connected to a movable electrode and extended to the outside of the vacuum valve; a tapered male contact of the disconnecting switch including a retaining spring wound round and locked by the control rod for resiliently urging the movable electrode to the open state at all times and also including a stepped portion connected to the control rod and having a larger diameter than that of the control rod; an axially reciprocable conductive member having one side thereof coupled to a driving unit and the other side thereof sliding over a sliding contact which is integral with a terminal connected to either one of electric circuits; a female contact of the disconnecting switch disposed to oppose to the male contact and to be movable into or out of contact with the male contact, including a stopper adapted to make the vacuum switch close by overcoming a resilient force of the retaining spring in a closing stroke when the load switch is closed, and also including a locking mechanism engaged with the stepped larger-diameter portion of the male contact so as to open the vacuum switch prior to opening of the disconnecting switch when the load switch is opened; and a terminal connected to the other of the electric circuits.

DETAILED DESCRIPTION

Figure 1:
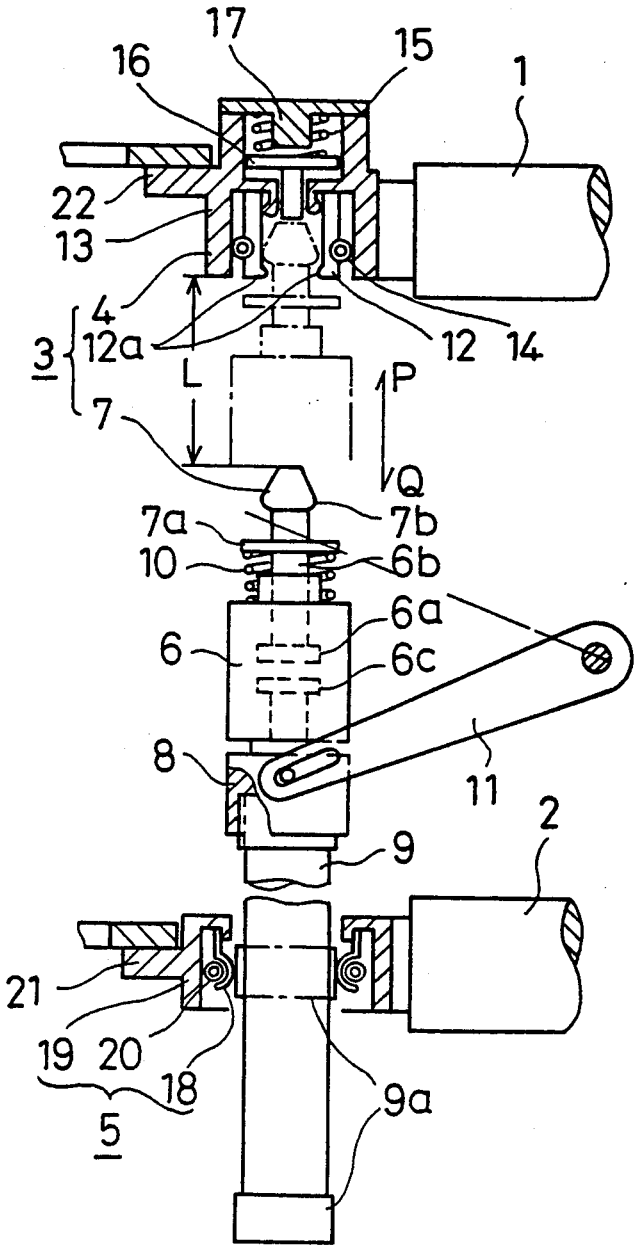
FIG. 1 is a partially sectioned illustration showing essential parts of a vacuum load switch with a disconnecting switch in accordance with one embodiment of this invention.

In the following, preferred embodiments of this invention will be described with reference to the drawings. FIG. 1 shows an essential part of the load switch in accordance with one embodiment in the disconnected state. Referring to the drawing, an upper and lower support insulator 1, 2 are mounted to a not shown frame. A female contact 4 constituting the fixed side of a disconnecting switch 3 is attached to the upper support insulator 1, while a sliding contact 5 is attached to the lower support insulator 2 so that it is disposed on the same shaft to oppose to the female contact 4. A movable part of the load switch extends through the sliding contact 5 to be movable in the axial direction. This movable part comprises a vacuum valve 6, a male contact 7 constituting the movable side of the disconnecting switch 3 connected to an axially movable control rod **6*b* which is in turn connected to a movable electrode 6*a* of the vacuum switch 6 and extending to the outside of the vacuum switch, a fuse 9 serving as also a conductive member and having one end thereof coupled to a fixed electrode 6*c* of the vacuum switch 6 via a connecting member 8, and a retaining spring 10 which is locked by a flanged portion 7*a* locating at a connected portion between the male contact 7 and the control rod 6*b* so as to resiliently urge the movable electrode 6*a* to the open state at all times, all of these parts and members being disposed on the same shaft. The disconnecting switch 3 is reciprocated by means of a crank 11 which is coupled to the connecting member 8 and linked to a not shown driving unit for rotation. While the disconnecting switch 3 is closed, a conductive cap 9*a* provided at the lower end of the fuse 9 is brought into contact with the sliding contact 5. Meanwhile, the female contact 4 comprises a plurality of contact pieces 12 disposed in the radial form with respect to the axis, a contact piece support 13 for holding the contact pieces 12 so as to mount the same on the support insulator 1, a contact spring 14 wound round the outside of each contact piece 12 for pressing the contact piece 12 toward the axis, a movable stopper 16 supported within the contact piece support 13 in a movable manner in the axial direction and resiliently urged from above in the drawing by a buffer spring 15 serving as also a contact spring for the electrodes of the vacuum switch, and a fixed stopper 17 which locates at an open end of the contact piece support 13 opposite to the other open side including the contact pieces 12, thereby to enclose the open end, locks one end of the buffer spring 15 and functions to restrict a moving stroke of the movable stopper 16. The sliding contact 5 comprises a plurality of contact pieces 18 disposed in the radial form with respect to the axis, a contact piece support 19 for holding the contact pieces 18 so as to mount the same on the support insulator 2, and a contact spring 20 wound round the outside of each contact piece 18 for pressing the contact piece 18 toward the axis. The contact piece support 19 of the sliding contact 5 is provided with a terminal 21 connected to either one of electric circuits, while the contact piece support 13 of the female contact 4 is provided with a terminal 22 connected to the other of the electric circuits. As mentioned above, the retaining spring 10 has a resilient force enough to hold the open state between the movable electrode 6*a* and the fixed electrode 6*c* of the vacuum switch 6 under the disconnected state thereof, i.e. in the normal state. Moreover, the resilient force of the retaining spring 10 is so selected that, when the male contact 7 is brought into contact with the female contact 4 and the tip end of the male contact 7 spreads the the contact pieces 12 outwardly in the closing operation in the direction shown by an arrow P, the vacuum switch 6 will not close by a component in the direction shown by an arrow Q of a resilient force of the contact spring 14 toward the axis. In addition, the retaining spring 10 is also selected to have such a resilient force that it begins to be compressed by a resilient force of the buffer spring 15 only when the male contact 7 strikes upon the movable stopper 16, and then the movable electrode 6*a* of the vacuum switch 6 is brought into contact with the fixed electrode 6*c* thereof. A resilient force of the contact spring 14 is selected so as to not only secure the predetermined current capacity between the male contact 7 and the contact pieces 12 of the female contact 4, but also temporarily hold the engagement between a locking projection 12*a* provided on each contact piece 12 at the open side thereof and projecting toward the axis and a step formed at the interface of the control rod 6*b* and the larger-diameter portion 7*b* of the male contact 7, in the disconnecting operation of the disconnecting switch 3 in the direction shown by the arrow Q. By so doing, prior to disconnection of the disconnecting switch 3, the movable electrode 6*a* is released from the fixed electrode 6*c* so that the vacuum switch 6 is opened. Subsequently, the male contact 7 is disconnected from the locking projections 12*a* and, hence, there is secured a certain insulating distance as an open distance L between the male contact 7 and the female contact 4**. This open distance L can be confirmed visually.

Figure 2:
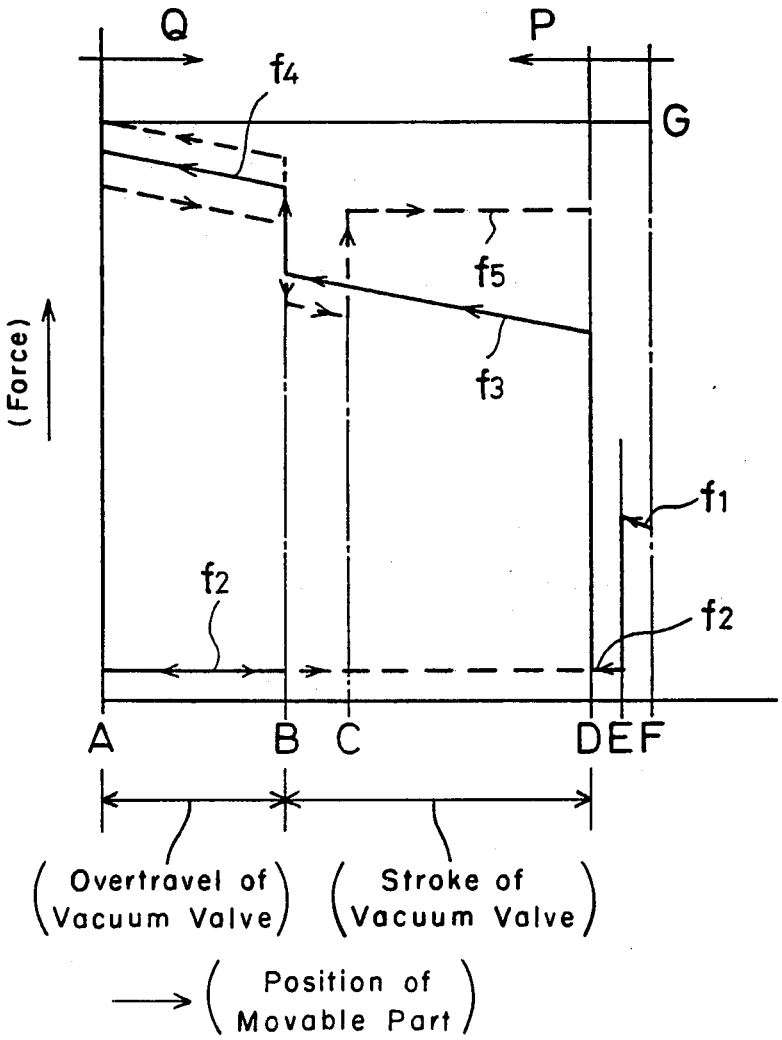
FIG. 2 is a graph for explaining the operation of the load switch shown in FIG. 1.

Referring to FIG. 2, there will be described in more detail the relationship between a position of the movable part (the vacuum switch 6, the male contact 7 and the fuse 9 unitized into one piece) and resilient forces of the retaining spring 10, the contact spring 14 and the buffer spring 15, in the opening and closing operations as mentioned above. In the drawing, the axis of ordinates represents a degree of exerted forces and the axis of abscissas represents a position of the movable part. Firstly, at an action starting position F where the male contact 7 is brought into contact with the female contact 4 and the larger-diameter portion **7*b* spreads the locking projections 12*a* outwardly, after the movable part has started to move in the direction shown by the arrow P upon the closing operation, the movable part is subject to an acting force $f_1$ due to a resilient force of the contact spring 14 in the direction shown by the arrow Q. At this time, since a resilient force of the retaining spring 10 is selected to be greater than that of the acting force $f_1$, the vacuum switch will not be closed. When the male contact 7 moves forward and reaches a position E where the stepped portion 7*b* is released from the projections 12*a*, the acting force $f_1$ is changed to a sliding frictional force $f_2$ exerted between the current passing contact portions of the contact pieces 12 and the larger-diameter portion 7*b*. When the male contact 7 moves further forward and reaches a position D where the tip end of the male contact 7 abuts with the movable stopper 16, the male contact 7 is relatively pushed in the direction shown by the arrow Q because the the retaining spring 10 is selected to have a resilient force $f_3$ smaller than a resilient force $f_4$ of the buffer spring 15. Thus, the movable electrode 6*a* of the vacuum switch 6 is moved toward the fixed electrode 6*c* and then reaches a position B where both the electrodes 6*a* and 6*c* are brought into contact with each other. Thereafter, the subsequent closing operation causes the male contact 7 to further move forward, so that the tip end of the male contact 7 pushes the movable stopper 16 through its full stroke while giving a contact pressure due to the buffer spring 15 between both the electrodes of the vacuum switch 6. Finally, at a position A where the tip end of the male contact 7 abuts with the fixed stopper 17, the closing operation of the disconnecting switch 3 is completed. The disconnecting switch 3** is held in this state by a not shown retaining mechanism.

In the moving process of the movable part as stated above from the position D to the position B or from a later-described position C to the position D, there occurs no relative movement between the larger-diameter portion **7*b* and the contact pieces 12, so that the male contact 7 will not subject to the sliding frictional force $f_2$. But, in the moving process from the position B to the position A, this frictional force $f_2$ acts on the male contact 7. Therefore, the crank 11 for driving the movable part must be selected to have a driving force G in the direction shown by the arrow P that is greater than the sum of the resilient force $f_4$ of the buffer spring 15** and the frictional force $f_2$. In other words, it is required to meet the equation of $G > f_4 + f_2$.

Thereafter, when the retaining mechanism is released from its locked state upon the opening operation and the movable part starts to move in the direction shown by the arrow Q, the tip end of the male contact 7 is subject to a force given by subtracting the frictional force $f_2$ from the resilient force $f_4$ of the buffer spring 15. The male contact 7 becomes free from the force of $f_4 - f_2$ at the position B where the movable stopper 16 is blocked in its movement in the direction shown by the arrow Q. After that, the frictional force $f_2$ causes the retaining spring 10 to be stretched and the male contact 7 moves backward until the position C where the step of the larger-diameter portion **7*b* is locked by the projections 12*a*. A locking force $f_5$ due to this engagement is selected to be greater than the resilient force $f_3$ of the retaining spring 10, so that the male contact 7, i.e. the movable electrode 6*a* of the vacuum switch 6, is temporarily stopped in its movement in the direction shown by the arrow Q and, hence, only the fixed electrode 6*c*** continues to move until the position D. At this position D, the vacuum switch 6 completes its opening operation between both the electrodes thereof, thereby to cut-off the current supply through the load switch. Then, the engagement of the step of the larger-diameter portion 7b with the projections 12a is released by the subsequent driving force G greater than the locking force $f_5$, so that the movable part returns to the disconnected state as illustrated in FIG. 1. In order not to start the disconnecting operation of the disconnecting switch 3 until the electrodes 6a, 6b of the vacuum switch 6 complete the opening, i.e. cut-off, operation thereof, it is essential that the locking force $f_5$ between the step of the larger-diameter portion 7b and the projections 12a is greater than the resilient force $f_3$ of the retaining spring 10.

Although in the foregoing embodiment the buffer spring 15 has been selected to have its resilient force $f_4$ greater than the resilient force $f_3$ of the retaining spring 10, it is also possible to adopt the reversed relationship of $f_3' > f_4'$ so long as there is provided the fixed stopper 17. In this case, however, it will be naturally noted that the driving force G has to meet the equation of $G > f_3' + f_2$ and $f_3'$ has to meet the equation of $f_3' > f_3$.

Figure 3:
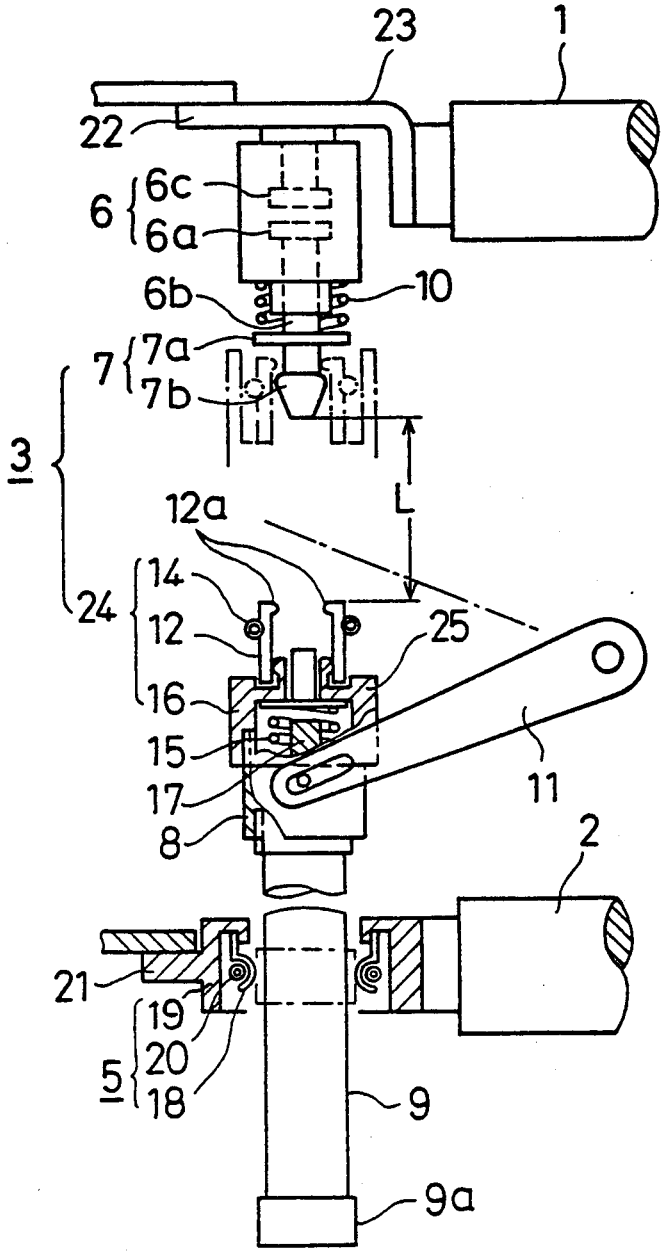
FIG. 3 is a partially sectioned illustration showing essential parts of a vacuum load switch with a disconnecting switch in accordance with another embodiment of this invention.

Another embodiment of this invention will be described hereinafter. This embodiment differs from the above stated embodiment as shown in FIG. 1 as follows. While in the foregoing embodiment the vacuum switch has been incorporated in the movable part of the load switch, the vacuum switch is incorporated in a fixed part of the load switch in this embodiment. Moreover, in connection with incorporation of the vacuum switch into the fixed part, the fixed contact and the movable contact of the disconnecting switch are reversed in their positions. Such arrangement is derived from the fact that, although the load switch of the type as mentioned above is generally desired to have a minimized driving force, at present the mass of the vacuum switch is greater than that of contacts of the usual disconnecting switch, and there may accompany a fear of lack in the mechanical strength when the vacuum switch is incorporated in the movable part. The second embodiment will be explained by referring to FIG. 3. Besides, the identical parts to those in the embodiment as shown in FIG. 1 are denoted by the identical symbols and the description about those parts will be omitted. In FIG. 3, the fixed part of the load switch is mounted to the upper support insulator 1 via a support hardware 23 which is provided with the terminal 22 connected to the other of the electric circuits and which is shaped into the form of a letter of L. The fixed part comprises the vacuum switch 6, the male contact 7 connected to the control rod 6b of the vacuum switch 6 so as to constitute the fixed side of the disconnecting switch 3, and the retaining spring 10 which is locked by the flanged portion 7a locating at a connected portion between the male contact 7 and the control rod 6b for resiliently urging the movable electrode 6a to the open state at all times. The movable part of the load switch is supported in an axially movable manner by the sliding contact 5 mounted to the lower support insulator 2. The movable part comprises a female contact 24 of the disconnecting switch 3 disposed to oppose to the male contact 7 and movable into or out of contact with the male contact 7, and the fuse 9 serving as also a conductive member and having one end thereof connected to the female contact 24 via the connecting member 8, these members being mounted on the same shaft. Moreover, the movable part is reciprocated by means of the crank 11 which is coupled to the connecting member 8 and also driven by a not shown driving unit to be turned. While the disconnecting switch 3 is closed, the conductive cap 9a provided at the lower end of the fuse 9 is brought into contact with the sliding contact 5. As will be seen from the drawing, the construction of the fixed part in this embodiment corresponds to that of the movable part in the foregoing embodiment as shown in FIG. 1, which similarly includes the vacuum switch 6, the male contact 7 and the retaining spring 10. Also, the movable part in this embodiment has the same construction as the fixed part of the foregoing embodiment except for that a contact piece support 25 for the female contact 24 differs from the contact piece support 13 in FIG. 1 in its form, because it is simplified due to incorporation into the movable part, and hence functions similarly thereto. Therefore, the detailed description about the construction of this embodiment will dispensed with.

Since the construction of this embodiment is basically similar to that of the foregoing embodiment as shown in FIG. 1, the operation takes place in a similar manner and it is also possible to make similar modifications in its construction. In this embodiment, however, the vacuum switch is incorporated in the fixed part of the load switch as mentioned above to reduce the mass of the movable part, so that the load switch may have a longer life time and the driving unit may be further reduced in its size. As a result, this embodiment has still higher values in the practical use.

In any embodiment as explained in the above, the load switch has been provided with a fuse, i.e. a protective device for preventing an excessive current including a false current. But it is also possible to dispense with such excessive current protective device by using other conductive members such as a copper tube in place of the fuse.

As fully described hereinbefore, according to this invention, a vacuum switch and an air disconnecting switch of linearly moving type ar unitized to form a load switch, so it becomes possible to easily carry out the visual confirmation of safety and to perform opening and closing of the switch without generating any sparks. Therefore, this invention can contribute to reduce the size, increase the safety and facilitate the handling of enclosures such as a switchboard.

I claim:

1. A vacuum load switch comprising:

a vacuum switch having a movable electrode, a fixed electrode, an axially movable control rod having one end attached to the movable electrode and a retaining spring wound around and locked by the control rod for exerting a resilient force tending to separate the electrodes of the vacuum switch;

a disconnecting switch comprising a tapered male contact and an opposing female contact shaped to permit insertion of the male contact therein, the male contact having a relatively small diameter tip portion and a relatively larger diameter base portion attached to the other end of the control rod, the base portion having a larger diameter than the control rod and forming a step therewith, the female contact including spring loaded locking projections for releasably engaging the step of the male contact, and a stopper for exerting a force on the control rod sufficient to close the electrodes of the vacuum switch when the male contact is caused to abut the stopper following engagement of the contacts; and an axially reciprocable conductive member coupled to driving means for moving the conductive member in one or the opposite axial direction to cause the load switch to respectively close or open, the conductive member being in sliding electrical contact with a first terminal, the spring loading of the locking projections, the shapes of the male and female contacts and the resilient force exerted by the retaining spring being such that the force on the control rod during engagement of the male and female contacts is insufficient to close the electrodes of the vacuum switch and the force on the control rod during disengagement of the male and female contacts is sufficient to fully separate the electrodes of the vacuum switch prior to the release of the male contact by the female contact.

2. A vacuum load switch according to claim 1 wherein the fixed electrode of the vacuum switch is attached to the conductive member and the female contact is attached to a second terminal and spaced a predetermined distance from the male contact when the disconnecting switch is fully open.

3. A vacuum load switch according to claim 1 wherein the fixed electrode of the vacuum switch is attached to a second terminal and the female contact is attached to the conductive member and spaced a predetermined distance from the male contact when the disconnecting switch is fully open.

4. A vacuum load switch according to claim 1, 2, or 3 wherein the conductive member includes a fuse.

5. A vacuum load switch according to claim 1, 2, or 3 wherein the stopper is axially movable and spring loaded to exert a resilient force on the male contact greater than the resilient force exerted by the retaining spring when the male contact is caused to abut the stopper.

6. A vacuum load switch according to claim 1, 2, or 3 wherein the stopper has an axially movable portion and a fixed portion and there is included a spring interposed between the fixed and movable portions of the stopper for exerting a resilient force smaller than the resilient force exerted by the retaining spring.

7. A vacuum load switch according to claim 4 wherein the stopper is axially movable and spring loaded to exert a resilient force greater than the resilient force exerted by the retaining spring when the male contact is caused to abut the stopper.

8. A vacuum load switch according to claim 4 wherein the stopper includes an axially movable portion and a fixed portion and there is included a spring interposed between the fixed and movable portions of the stopper for exerting a resilient force smaller than the force exerted by the retaining spring.

* * * * *